US008311426B2

(12) United States Patent
Shishikura et al.

(10) Patent No.: US 8,311,426 B2
(45) Date of Patent: Nov. 13, 2012

(54) IMAGE FORMING APPARATUS

(75) Inventors: Shunichiro Shishikura, Kanagawa (JP); Yasunori Unagida, Kanagawa (JP); Naoya Yamasaki, Kanagawa (JP); Takeshi Yasuda, Kanagawa (JP); Hidefumi Tanaka, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 191 days.

(21) Appl. No.: 12/700,096

(22) Filed: Feb. 4, 2010

(65) Prior Publication Data

US 2011/0052229 A1 Mar. 3, 2011

(30) Foreign Application Priority Data

Aug. 26, 2009 (JP) ..... 2009-195635

(51) Int. Cl.
*G03G 15/00* (2006.01)
*G03G 15/01* (2006.01)

(52) U.S. Cl. ..... 399/49; 399/302

(58) Field of Classification Search ..... 399/49, 399/299, 302

See application file for complete search history.

(56) References Cited

U.S. PATENT DOCUMENTS 6,889,015 B2 * 5/2005 Shimura ..... 399/49
2008/0292368 A1 * 11/2008 Baretsky et al. ..... 399/301

FOREIGN PATENT DOCUMENTS

JP 2002-040726 A 2/2002
JP 2003-280317 A 10/2003
JP 2007-148259 A 6/2007

* cited by examiner

*Primary Examiner* — David Gray
*Assistant Examiner* — Erika J Villaluna
(74) *Attorney, Agent, or Firm* — Sughrue Mion, PLLC

(57) ABSTRACT

An image forming apparatus includes an image carrier and a detection unit. The image carrier is stretched around a plurality of rolls. The detection unit detects a density of a toner image formed on the image carrier, based on an amount of regularly reflected light from a surface of the image carrier. A detection length where the detection unit performs the detection in a movement direction of the image carrier is longer than a length, in the movement direction of the image carrier, of a deformation area where a deformation of the image carrier is caused.

6 Claims, 15 Drawing Sheets

10 INTERMEDIATE TRANSFER BELT, 12-16 A PLURALITY OF ROLLS,
36 WRAPPING KINK (DEFORMATION), 41 ADC SENSOR (DETECTION MEANS)

IMAGE FORMING APPARATUS

CROSS-REFERENCE TO RELATED APPLICATION

This application is based on and claims priority under 35 USC119 from Japanese Patent Application No. 2009-195635 filed on Aug. 26, 2009.

BACKGROUND

1. Technical Field

This invention relates to an image forming apparatus.

2. Related Art

As an image forming apparatus as mentioned above, a type is available in which a toner image for detecting the image density and the image formation position is formed on a toner image carrier such as an intermediate transfer belt or a photoreceptor and the density and position of the toner image are optically detected by using regularly reflected light or diffusely reflected light.

SUMMARY

According to an aspect of the invention, an image forming apparatus includes an image carrier and a detection unit. The image carrier is stretched around a plurality of rolls. The detection unit detects a density of a toner image formed on the image carrier, based on an amount of regularly reflected light from a surface of the image carrier. A detection length where the detection unit performs the detection in a movement direction of the image carrier is longer than a length, in the movement direction of the image carrier, of a deformation area where a deformation of the image carrier is caused.

BRIEF DESCRIPTION OF THE DRAWINGS

Exemplary embodiments of the invention will be described in detail based on the following figures, wherein.

DETAILED DESCRIPTION

Hereinafter, an embodiment of this invention will be described with reference to the drawings.

First Embodiment

Figure 2:
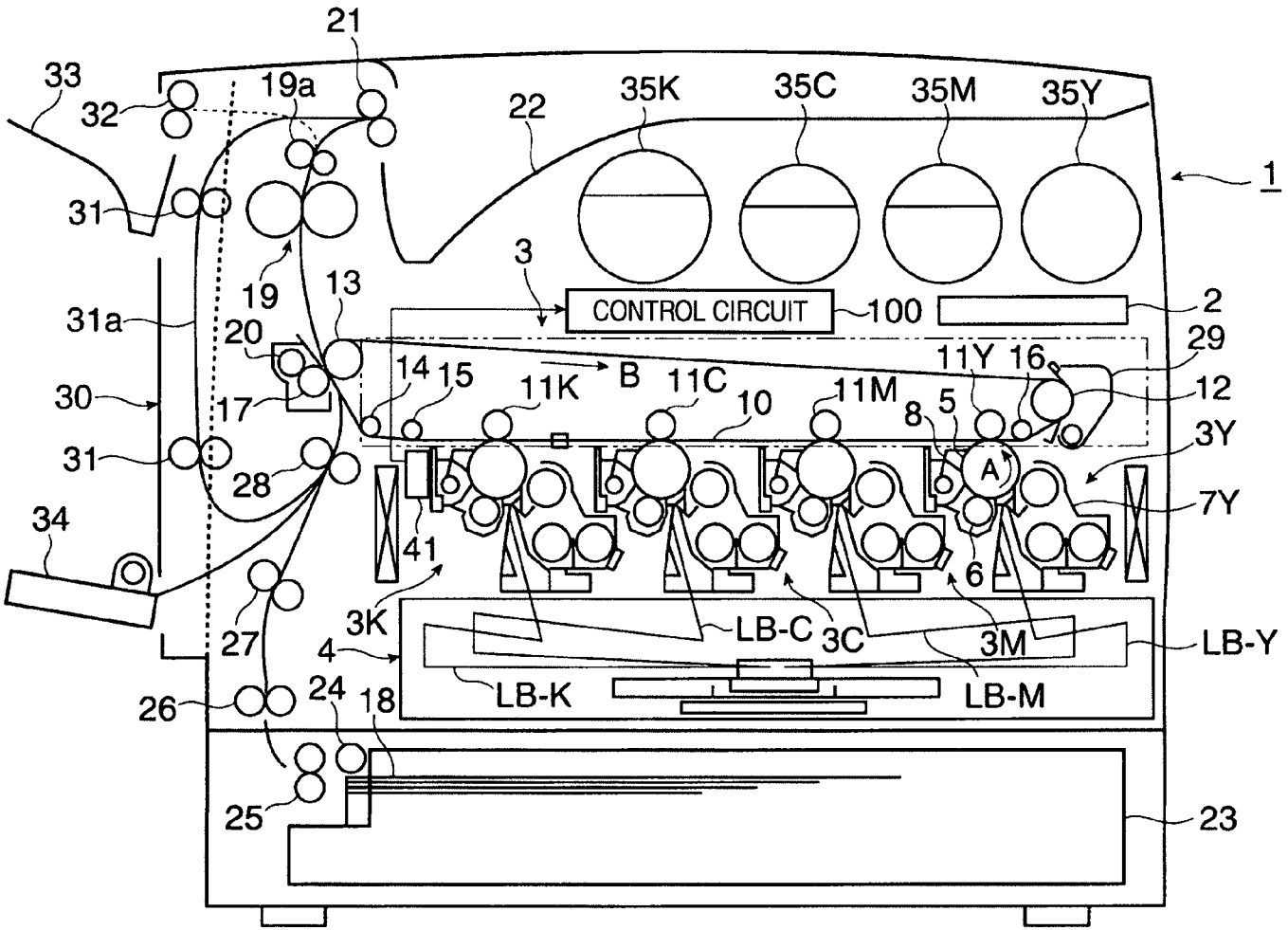
FIG. 2 is a structural view showing the color image forming apparatus as the image forming apparatus according to the first embodiment of this invention.

FIG. 2 shows a color image forming apparatus as an image forming apparatus according to a first embodiment of this invention. This color image forming apparatus is structured so as to function not only as a printer that prints image data transmitted from a non-illustrated personal computer (PC) or the like but also as a copier that copies the image of an original read by a non-illustrated image reader and a facsimile that transmits and receives image information.

In a color image forming apparatus body 1, as shown in FIG. 2, an image processor 2 is disposed that performs predetermined image processing such as shading correction, position shift correction, brightness/color space conversion, gamma correction, frame erasure and color/movement edit as required on the image data transmitted from the non-illustrated personal computer (PC) or image reader.

The image data having undergone the predetermined image processing by the image processor 2 as described above is converted into image data of four colors of yellow (Y), magenta (M), cyan (C) and black (K) also by the image processor 2, and outputted as a full-color image or a monochrome image by an image outputter 3 provided in the color image forming apparatus 1 as described next.

In the color image forming apparatus body 1, as shown in FIG. 2, four image forming units (image formers) 3Y, 3M, 3C and 3K of yellow (Y), magenta (M), cyan (C) and black (K) are arranged in parallel at regular intervals.

The image data converted into image data of four colors of yellow (Y), magenta (M), cyan (C) and black (K) by the image processor 2 is sent to an image exposing unit 4 common to the image forming units 3Y, 3M, 3C and 3K of yellow (Y), magenta (M), cyan (C) and black (K). In the image exposing unit 4, image exposure is performed by performing deflection scanning with four laser beams LB-Y, LB-M, LB-C and LB-K according to the image data of the corresponding color.

These four image forming units 3Y, 3M, 3C and 3K are basically structured similarly except for the colors of the images that they form, and as shown in FIG. 2, are constituted broadly by a photoreceptor drum 5, a charging roll 6, the image exposing unit 4, a developing unit 7, and a cleaning unit 8. The photoreceptor drum 5 as the image carrier rotated at a predetermined speed (for example, 126 mm/sec) in the direction of the arrow A by non-illustrated driving unit. The charging roll 6 for primary charging uniformly charges the surface of the photoreceptor drum 5. The image exposing unit 4 forms an electrostatic latent image on the surface of the photoreceptor drum 5 by exposing an image corresponding to a predetermined color. The developing unit 7 develops the electrostatic latent image formed on the photoreceptor drum 5, with toner of the predetermined color. The cleaning unit 8 cleans the surface of the photoreceptor drum 5.

As the photoreceptor drum 5, for example, one is used that has the form of a drum with a diameter of 30 mm and has its surface coated with an organic photoconductor (OPC) or the like. The photoreceptor drum 5 is rotated at the predetermined speed in the direction of the arrow A by a non-illustrated motor.

As the charging roll 6, for example, a roll-form charger is used where the surface of the metal core is coated with a conductive layer made of a synthetic resin or rubber and having its electric resistance adjusted. A predetermined charged bias is applied to the metal core of the charging roll 6.

The image exposing unit 4 is, as shown in FIG. 2, common to the four image forming units 3Y, 3M, 3C and 3K, and is structured so as to emit the four laser beams LB-Y, LB-M, LB-C and LB-K modulated according to the image data of yellow (Y), magenta (M), cyan (C) and black (K), respectively, and expose the surface of each photoreceptor drum 5 by scanning it in a main scanning direction with these four laser beams LB-Y, LB-M, LB-C and LB-K. As shown in FIG. 2, the image exposing unit 4 is structured so as to perform image exposure on the surfaces of the photoreceptor drums 5 from below.

It is to be noted that as the image exposing unit 4, one made of an LED array or the like individually provided for each photoreceptor drum may be used.

From the image processor 2, image data of corresponding colors is outputted to the image exposing unit 4 common to the image forming units 3Y, 3M, 3C and 3K of yellow (Y), magenta (M), cyan (C) and black (K), and the surfaces of the corresponding photoreceptor drums 5 are exposed by being scanned with the laser beams LB-Y, LB-M, LB-C and LB-K emitted from the image exposing unit 4 in accordance with the image data, thereby forming electrostatic latent images corresponding to the image data. The electrostatic latent images formed on the photoreceptor drums 5 are developed as toner images of yellow (Y), magenta (M), cyan (C) and black (K) by the developing units 7Y, 7M, 7C and 7K, respectively.

The toner images of yellow (Y), magenta (M), cyan (C) and black (K) successively formed on the photoreceptor drums 5 of the image forming units 3Y, 3M, 3C and 3K are primarily transferred in succession by four primary transfer rolls 11Y, 11M, 11C and 11K onto an intermediate transfer belt 10 as the endless-belt-form image carrier (intermediate transfer member) disposed over the image forming units 3Y, 3M, 3C and 3K, so as to be superimposed on one another.

As shown in FIG. 2, the intermediate transfer belt 10 is stretched around a plurality of rolls consisting of a driving roll 12, a back supporting roll 13, a tension applying roll 14, a sensor roll 15 and a following roll 16 under a constant tension, and is circularly moved in the direction of the arrow B at a predetermined speed (for example, 126 mm/sec) by the driving roll 12 rotated by a non-illustrated driving motor excellent in constant speed maintaining capability. As the intermediate transfer belt 10, for example, one is used that takes the form of an endless belt made of a film of a synthetic resin such as a polyamide-imide resin having flexibility. The intermediate transfer belt 10 is disposed so as to be in contact with the photoreceptor drums 5Y, 5M, 5C and 5K of the image forming units 3Y, 3M, 3C and 3K in its lower running area.

Moreover, as shown in FIG. 2, a secondary transfer roll 17 disposed on the left side end of the running area of the intermediate transfer belt 10 is set so as to abut on the surface of the intermediate transfer belt 10 wrapped around the back supporting roll 13. The secondary transfer roll 17 is provided as secondary transfer unit for secondarily transferring the toner images primarily transferred onto the intermediate transfer belt 10, onto a recording medium 18.

Figure 3:
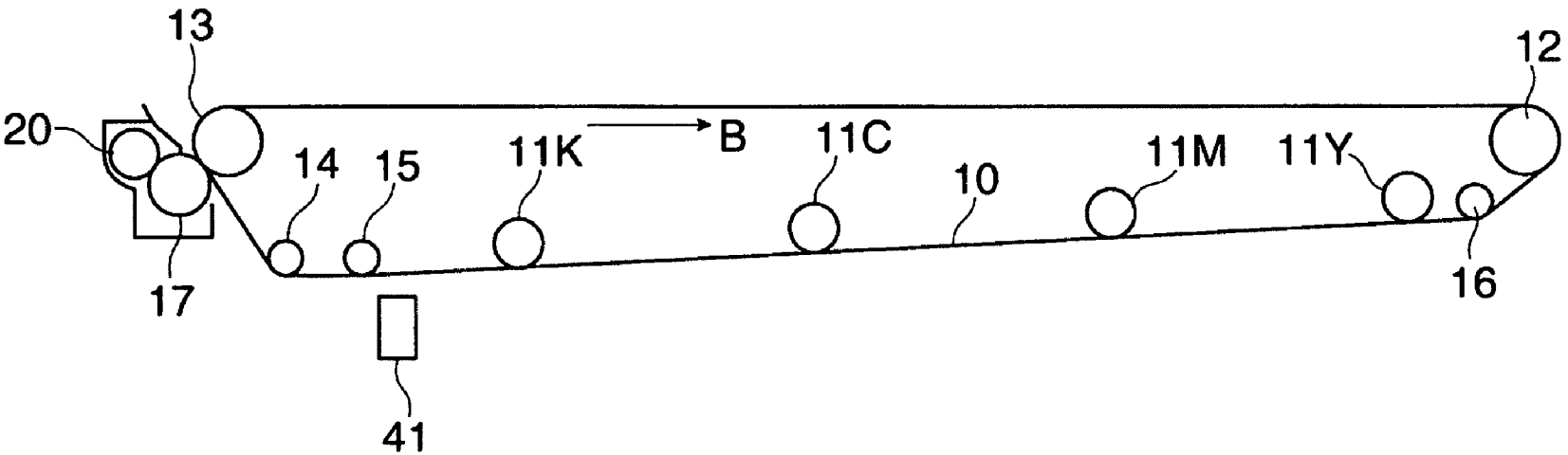
FIG. 3 is a structural view showing the stretching condition of an intermediate transfer belt.
Figure 4:
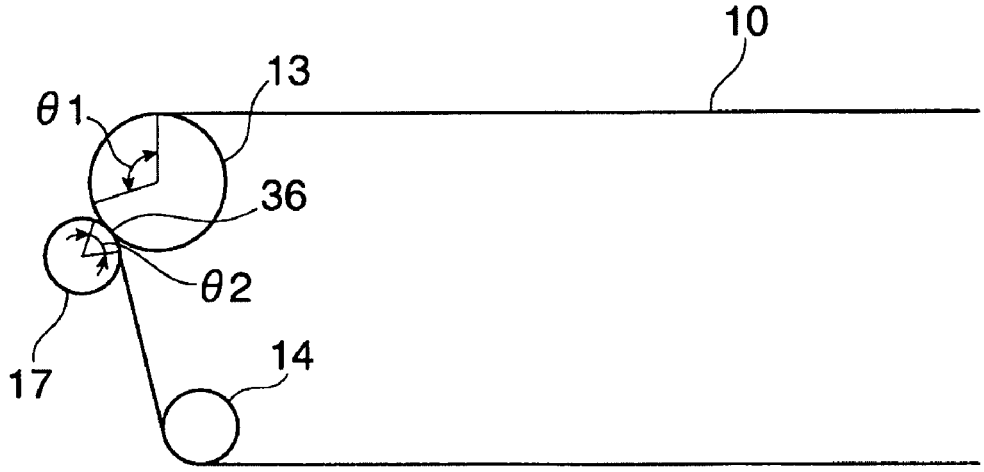
FIG. 4 is a structural view showing the stretching condition of the intermediate transfer belt.

The toner images of yellow (Y), magenta (M), cyan (C) and black (K) transferred onto the intermediate transfer belt 10 so as to be superimposed on one another are, as shown in FIGS. 2 and 3, secondarily transferred onto the recording sheet 18 as the recording medium by the secondary transfer roll 17 abutting on the back supporting roll 13 through the intermediate transfer belt 10. The recording sheet 18 where the toner images of the colors have been transferred is conveyed to a fixing unit 19 situated above in the vertical direction. As shown in FIG. 4, the secondary transfer roll 17 abuts on a side of the back supporting roll 13 through the intermediate transfer belt 10 curved substantially in an S shape, and collectively secondarily transfers the toner images of the colors onto the recording sheet 18 conveyed upward from below in the vertical direction. In FIG. 4, reference designation θ1 represents the wrap angle of the intermediate transfer belt 10 with respect to the back supporting roll 13, and reference designation θ2 represents the wrap angle of the intermediate transfer belt 10 with respect to the secondary transfer roll 17.

As the secondary transfer roll 17, for example, one is used where the periphery of the core made of a metal such as stainless steel is coated with an elastic layer of a predetermined thickness made of a conductive elastic material such as a rubber material to which a conductive agent is added. A cleaning roll (or a cleaning brush) 20 is disposed so as to be in contact with the secondary transfer roll 17.

As shown in FIG. 2, the recording sheet 18 where the toner images of the colors have been transferred undergoes fixing by heat and pressure by the fixing unit 19, and is then ejected into an output tray 22 provided at an upper end of the apparatus body 1, by ejection rolls 21 through output rolls 19*a* of the fixing unit 19 with the image formed surface facing below.

As the recording sheet 18, as shown in FIG. 2, a sheet of a predetermined size and material is fed in a condition of being separated one from another by a paper feed roll 24 and sheet separation and conveyance rolls 25 from a paper feed tray 23 disposed in a lower part of the apparatus body 1, is temporarily conveyed to resist rolls 28 through conveyance rolls 26 and 27, and is stopped there. Then, the recording sheet 18 supplied from the paper feed tray 23 is sent out to a secondary transfer position of the intermediate transfer belt 10 by the rotating resist rolls 28 at a predetermined time. As the recording sheet 18, thick paper such as coated paper one surface or both surfaces of which are covered with a coating can be supplied as well as plain paper. To the recording sheet 18 of coated paper, photographic images and the like are outputted as well.

From the surface of the intermediate transfer belt 10 where the secondary transfer process of the toner images has been finished, residual toner and the like are removed by a belt cleaning unit 29 provided in the position of the driving roll 12 to be ready for the next image formation process.

Moreover, in the above-described fullcolor image forming apparatus, a two-side unit 30 is optionally attachable to the left side surface of the apparatus body 1 as shown by the longitudinal broken line in FIG. 2. The two-side unit 30 is provided with a two-side sheet conveyance path 31*a* where conveyance rolls 31 that convey the recording sheet 18 having been reversed are provided. When images are formed on both surfaces of the recording sheet 18, while the rear end of the recording sheet 18 having an image formed on its one surface is sandwiched by the ejection rolls 21, the sheet conveyance path is switched by a non-illustrated gate, the ejection rolls 21 are reversed to convey the recording sheet 18 to the two-side sheet conveyance path 31*a*, and the recording sheet 18 is conveyed again to the resist rolls 28 in a reversed condition.

The two-side unit 30 is mounted with a face up output tray 33 into which the recording sheet 18 is ejected by ejection rolls 32 with the image formed surface facing upward and a manual paper feed tray 34 where the recording sheet 18 of a desired size and material can be fed.

In FIG. 2, reference designations 35Y, 35M, 35C and 35K represent toner cartridges that supplies toner to the developing units 7 of yellow (Y), magenta (M), cyan (C) and black (K), respectively.

Figure 5:
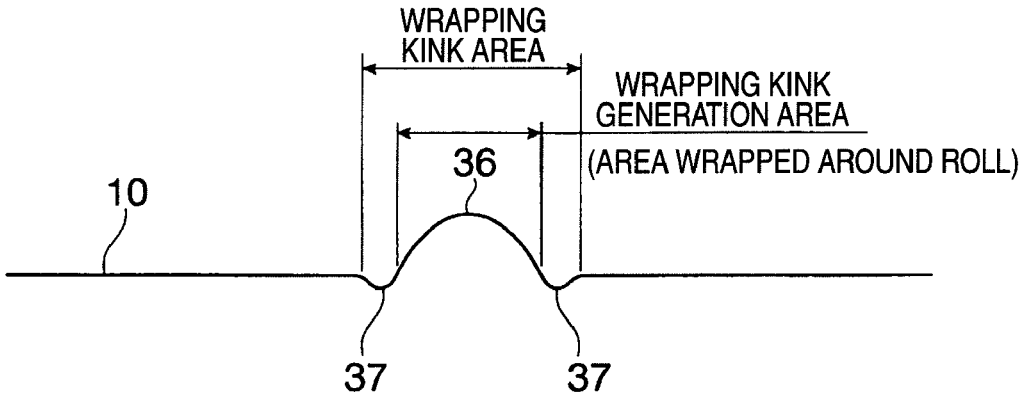
FIG. 5 is a schematic view showing a wrapping kink caused on the intermediate transfer belt.

According to researches by the present inventors and others, the following has been found: In a case where a polyamide-imide resin is used as the material of at least the main layer of the intermediate transfer belt 10 and the intermediate transfer belt 10 has the form of an endless belt using the polyamide-imide resin, when the intermediate transfer belt 10 is left for a long period of time, particularly, under a high-temperature and high-humidity environment (for example, 28° C. and 80% RH), the intermediate transfer belt 10 is plastically deformed by absorbing moisture, and in the areas of the intermediate transfer belt 10 wrapped around or abutting on the driving roll 12, the back supporting roll 13, the tension applying roll 14, the sensor roll 15, the following roll 16 and the primary transfer rolls 11Y, 11M, 11C and 11K as shown in FIG. 3, a wrapping kink 36 as a deformation along the outer shapes of the rolls is caused as shown in FIG. 5.

Here, the wrapping kink means that the intermediate transfer belt 10 is plastically deformed along the shapes of the driving roll 12, the back supporting roll 13, the tension applying roll 14, the sensor roll 15, the following roll 16, the primary transfer rolls 11Y, 11M, 11C and 11K and the like around which the intermediate transfer belt 10 is wrapped.

When the wrapping kink 36 is caused on the intermediate transfer belt 10, even if the intermediate transfer belt 10 is driven so as to move around by the driving roll 12, the back supporting roll 13 and the like, the wrapping kink 36 remains on the intermediate transfer belt 10 for a while.

The wrapping kink 36 caused on the intermediate transfer belt 10 differs also according to the outer shapes, that is, the diameters and wrap angles of the driving roll 12, the back supporting roll 13, the tension applying roll 14, the sensor roll 15, the following roll 16 and the primary transfer rolls 11Y, 11M, 11C and 11K where the intermediate transfer belt 10 is wrapped or abuts as shown in FIG. 3, or the length where the intermediate transfer belt 10 abuts on these rolls. Of the wrapping kinks 36 caused on the intermediate transfer belt 10, the largest wrapping kink 36 is caused at the back supporting roll 13 where the wrapping amount is largest as shown in FIG. 4, and the second largest wrapping kink 36 is caused at the driving roll 12 where the wrapping amount is the second largest.

At the back supporting roll 13, as shown in FIG. 4, with the intermediate transfer belt 10 being wrapped therearound, the secondary transfer roll 17 abuts on the back supporting roll 13 in a condition of being offset (shifted) toward the inside of the tangential line between the back supporting roll 13 and the tension applying roll 14. For this reason, the largest wrapping kink 36 is caused at the back supporting roll 13.

As schematically shown in FIG. 5, the wrapping kink 36 caused on the intermediate transfer belt 10 remains substantially as it is even in linearly stretched areas passing roll wrap areas. Consequently, the area of the wrapping kink 36 caused on the intermediate transfer belt 10 includes not only a generation area where the wrapping kink 36 is directly caused by the intermediate transfer belt 10 being wrapped around the back supporting roll 13 or the like but also front and back deformation areas 37 which are areas before the intermediate transfer belt 10 is returned to the linearly stretched area by the rigidity of the intermediate transfer belt 10, by the front and back areas, including the generation area of the wrapping kink 36, of the intermediate transfer belt 10 being linearly stretched.

Figure 6:
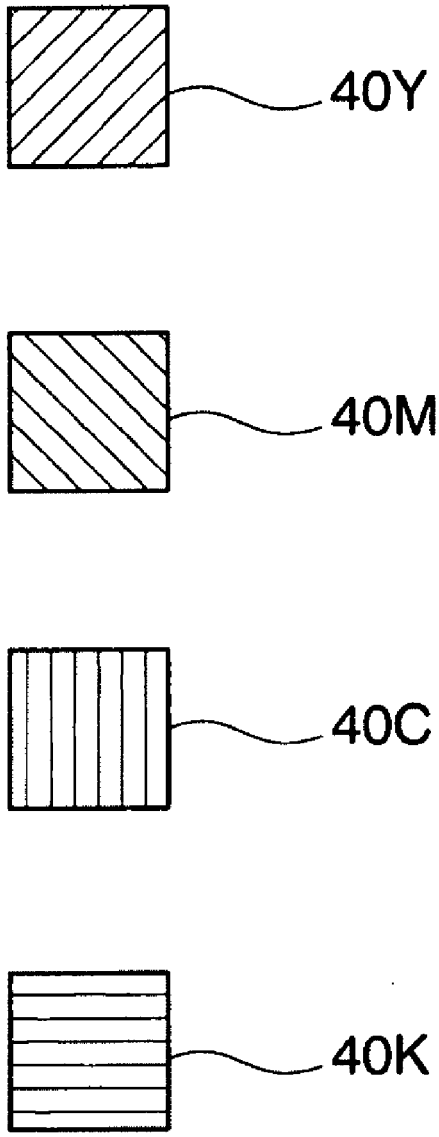
FIG. 6 is a structural view showing the toner patches.

In the color image forming apparatus structured as described above, as shown in FIG. 6, a plurality of control toner images 40Y, 40M, 40C and 40K (hereinafter, referred to as "toner patches") for controlling the image density, the amount of toner supplied to the developing unit 7, the charging potential of the photoreceptor drum 5 and the like are formed at a predetermined density on the intermediate transfer belt 10, and the densities of the toner patches 40Y, 40M, 40C and 40K formed on the intermediate transfer belt 10 are detected by an ADC sensor 41 as density detection unit based on the position of the sensor roll 15 disposed on the downstream side of the black image forming unit 3K on the movement path of the intermediate transfer belt 10.

Figure 7:
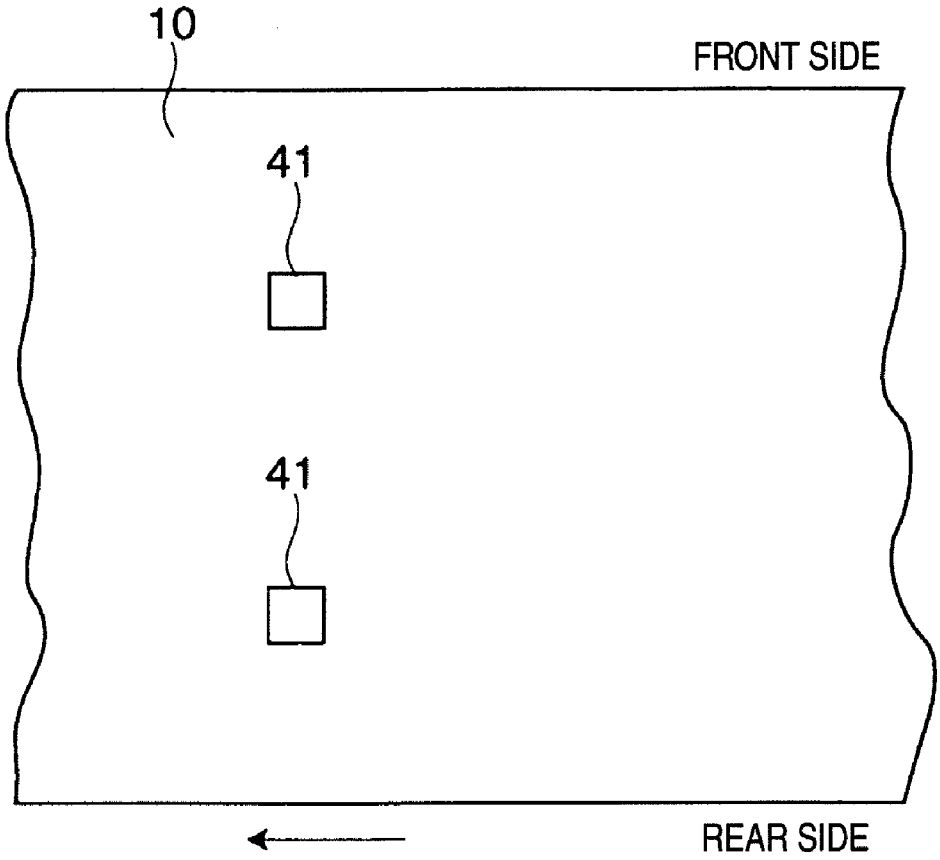
FIG. 7 is a structural view showing the arrangement of ADC sensors.

Moreover, in this embodiment, as shown in FIG. 7, a plurality of AD sensors 41 (two in the illustrated example) are arranged in a direction intersecting the movement direction of the intermediate transfer belt 10. The reflectances of the toner patches 40Y, 40M, 40C and 40K formed on the front and rear sides of the intermediate transfer belt 10 and the reflectance of the surface of the intermediate transfer belt 10 itself are detected by these ADC sensors 41.

The ADC sensor 41 is disposed not immediately below the sensor roll 15 but in a position slightly shifted from the position of the sensor roll 15 toward the upstream side (or the downstream side) in the movement direction of the intermediate transfer belt 10. This is because with the ADC sensor 41 that detects regularly reflected light, if the optical axis is shifted in the circumferential direction of the sensor roll 15 (the movement direction of the intermediate transfer belt 10), there is a possibility that no regularly reflected light is incident on the light receiving element and this makes detection impossible, and it is desirable to dispose the ADC sensor 41 in the position slightly shifted from the position of the sensor roll 15 toward the upstream side (or the downstream side) in the movement direction of the intermediate transfer belt 10 in consideration of the attachment precision and the like of the ADC sensors 41.

Figure 9B:
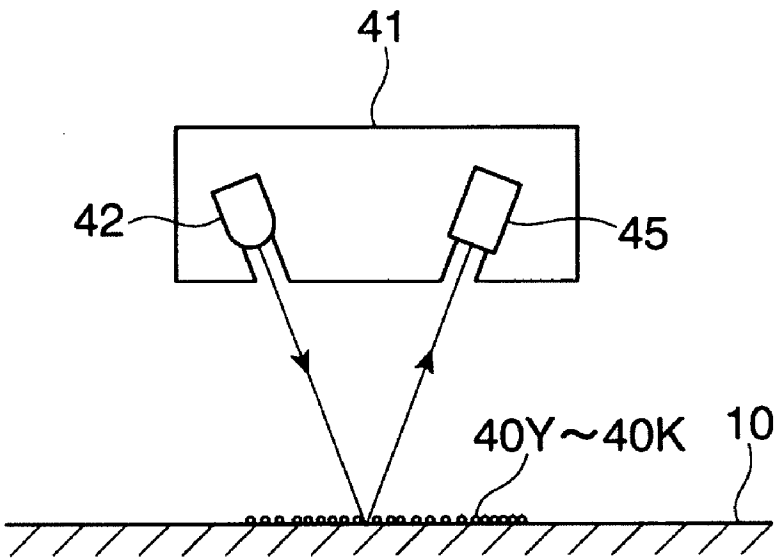
FIGS. 9A and 9B are structural views showing the ADC sensor.
Figure 9A:
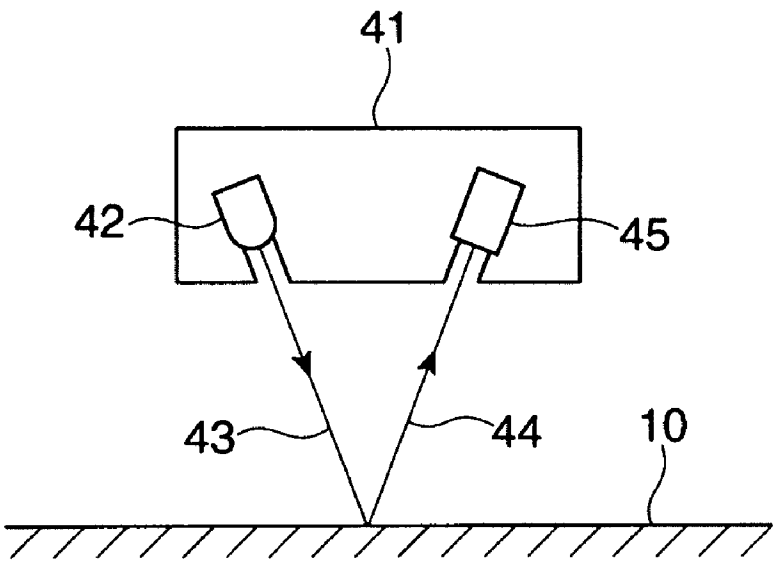
Figure 10:
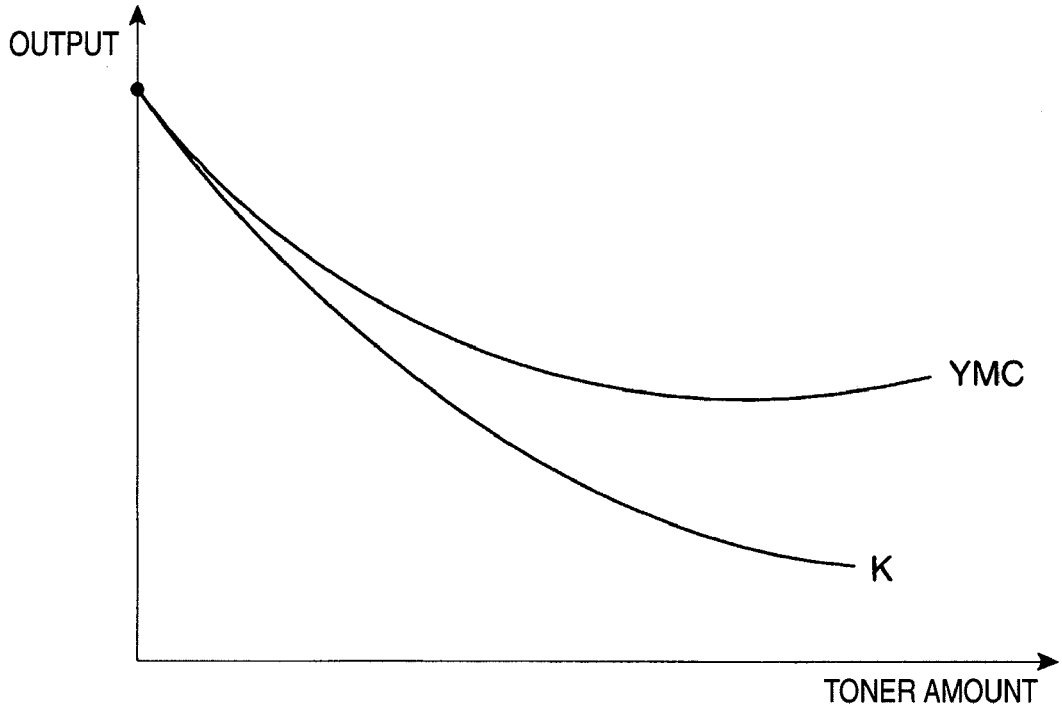
FIG. 10 is a graph showing the output signal of the ADC sensor.

As shown in FIGS. 9A and 9B, the ADC sensor 41 is a regular-reflection-type sensor that applies light 43 emitted from a light emitting device 42 such as an LED to the surface of the intermediate transfer belt 10 and the surface of the intermediate transfer belt 10 where the toner patch 40 is formed and detects regularly reflected light 44 from the surface of the intermediate transfer belt 10 by a light receiving element 45. As shown in FIG. 10, in the case of the color toner patches 40Y, 40M and 40C, as the toner amounts increases, the output from the ADC sensor 41 gradually decreases since the diffuse reflection and absorption by the toner increases, whereas in the case of the black toner patch 40K, as the toner amount increases, the output drastically decreases compared with the case of the color toners since the absorption by the toner drastically increases.

Figure 11:
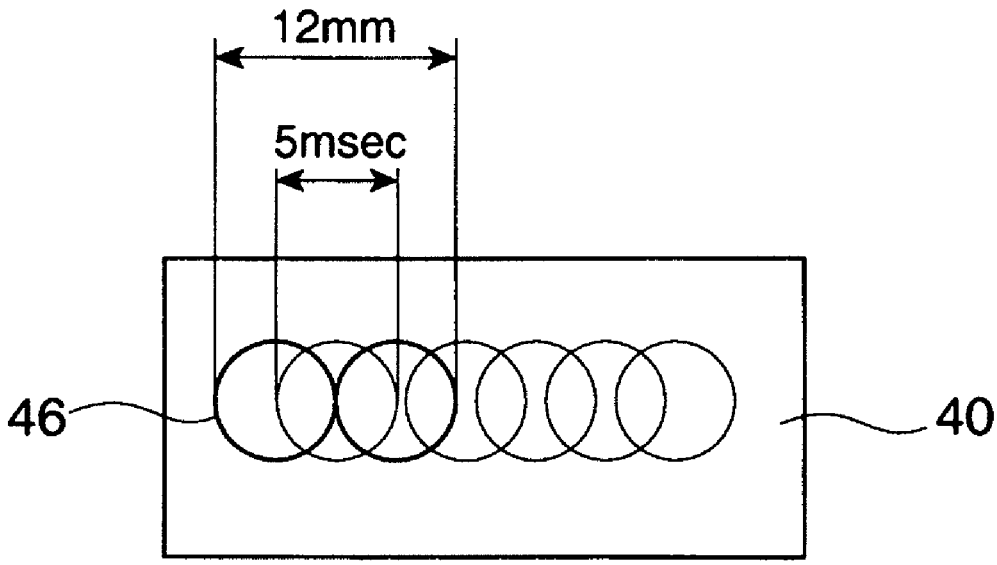
FIG. 11 is an explanatory view showing the toner patch detection condition.

Moreover, as shown in FIG. 11, the ADC sensor 41 has a circular detection area 46 with a diameter of approximately 6 mm within the toner patch 40. Every time sampling is performed on the detection area 46, for example, at twenty points every 5 msec in the movement direction of the intermediate transfer belt 10, the ADC sensor 41 averages, as the density of the toner patch, the sampling data at 18 points excluding the highest and lowest values, and continues the detection over the area of the toner patch 40 or a detection area of the surface of the intermediate transfer belt 10.

Here, the detection area means a range having a predetermined length (detection length) in the movement direction of the intermediate transfer belt 10 in order to detect the density of the toner patch 40 formed on the intermediate transfer belt 10, and includes not only the area where the toner patch 40 is formed but also the surface of the intermediate transfer belt 10 itself which is the object of the comparison for detecting the density of the toner patch 40.

Figure 8:
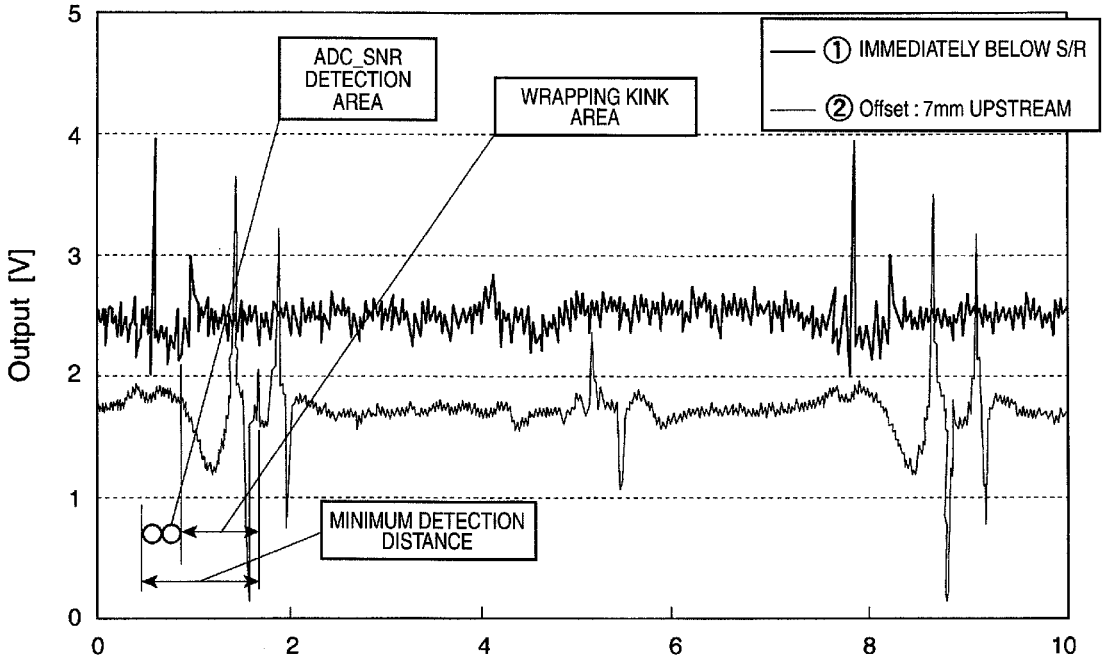
FIG. 8 is a waveform chart showing the output signal of the ADC sensor.

In that case, if the wrapping kink 36 is caused on the intermediate transfer belt 10 as shown in FIG. 5, the output of the ADC sensor 41 extremely largely fluctuates as shown in FIG. 8 when the wrapping kink area of the intermediate transfer belt 10 passes the ADC sensor 41, and the fluctuation appears as errors in the detected densities of the toner patches 40Y, 40M, 40C and 40K.

In the output of the ADC sensor 41, as shown in FIG. 11, when the area where sampling is performed at twenty points every 5 msec in the movement direction of the intermediate transfer belt 10 is regarded as one unit, in a case where the movement speed of the intermediate transfer belt 10 is set at 126 mm/sec, one sampling area of 5 msec×20 points is 126 (mm/sec)×5 (msec)×20=12.6 mm, thus a detection area with a width of 12.6 mm, that is, an area which is twice the detection area 46 of the ADC sensor 41 with a diameter of approximately 6 mm.

Figure 12:
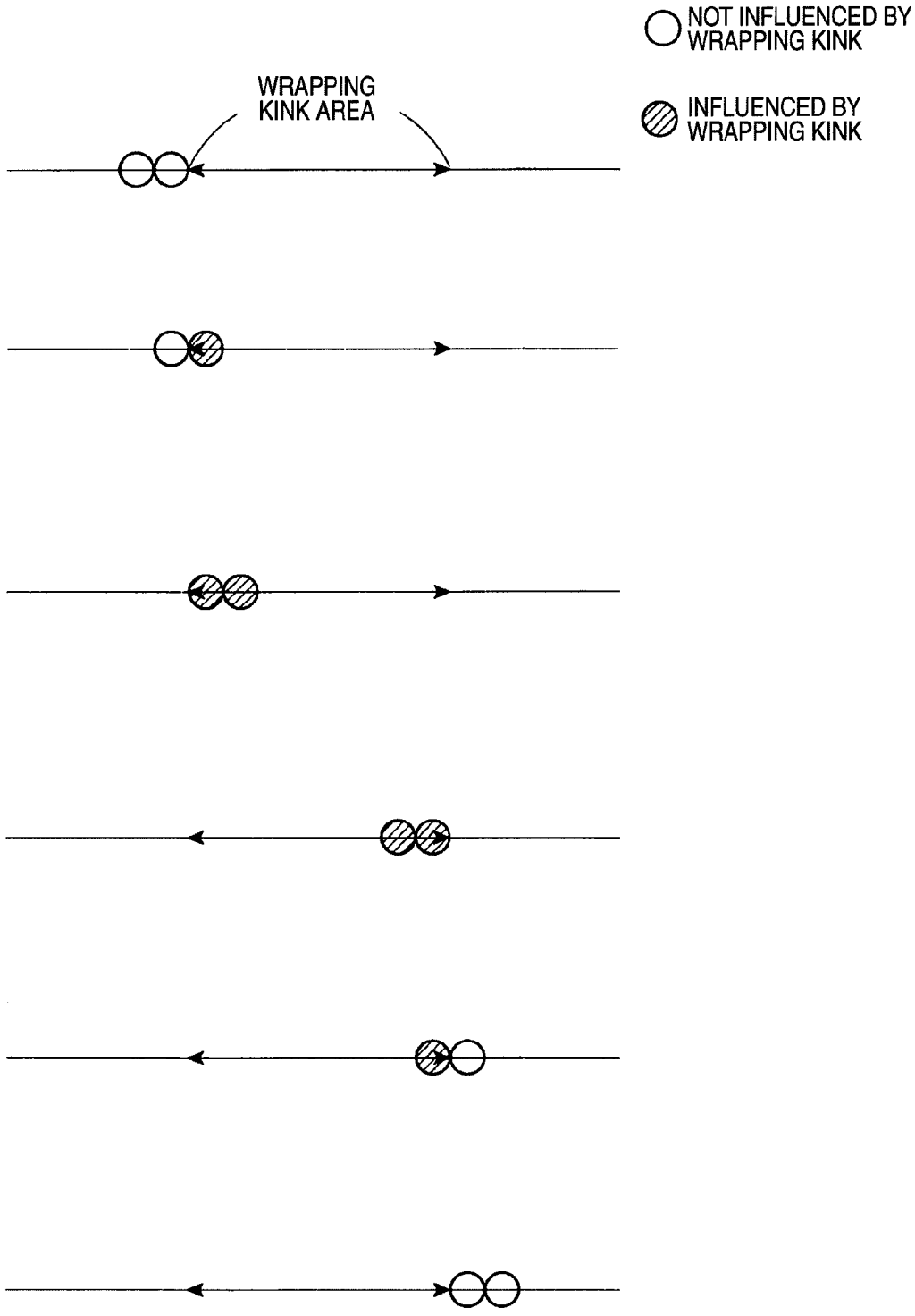
FIG. 12 is a schematic view showing a method of detecting the wrapping kink of the intermediate transfer belt by the ADC sensor.

That is, the area twice the detection area 46 of the ADC sensor 41 is a minimum area where the detection areas 46 of the ADC sensor 41 adjoin without overlapping each other, and by identifying the detection signal of the ADC sensor 41 from an area that is the sum of the area of the intermediate transfer belt 10 where the largest wrapping kink is caused and a distance twice the detection area 46 of the ADC sensor 41, it can be determined that the area is a wrapping kink area when, of two adjoining detection areas 46 of the ADC sensor 41, both of detection areas 46*a* and 46*b* and/or one of the detection areas 46*a* and 46*b* is changed by not less than a predetermined threshold value as shown in FIG. 12.

As shown in FIG. 2, the detection signal of the ADC sensor 41 is inputted to a control circuit 100 that functions also as detection area setting unit, wrapping kink determination unit and correction unit provided in the color image forming apparatus body 1. The control circuit 100 determines the wrapping kink generation area of the intermediate transfer belt 10 based on the detection signal from the ADC sensor 41.

Therefore, if the detection area of the ADC sensor 41 is set to an area that is the sum of the area of the largest wrapping kink 36 of the intermediate transfer belt 10 and the area twice the detection area 46 of the ADC sensor 41, since the output of the ADC sensor 41 should be stabilized at least in areas other than the area of the wrapping kink 36 of the intermediate transfer belt 10, the presence or absence of generation of the wrapping kink 36 can be determined.

Therefore, this embodiment is provided with the detection area setting unit for setting the detection area of the detection unit in the movement direction of the endless-belt-form image carrier, to an area larger than the wrapping kink area caused on the endless-belt-form image carrier.

Figure 1:
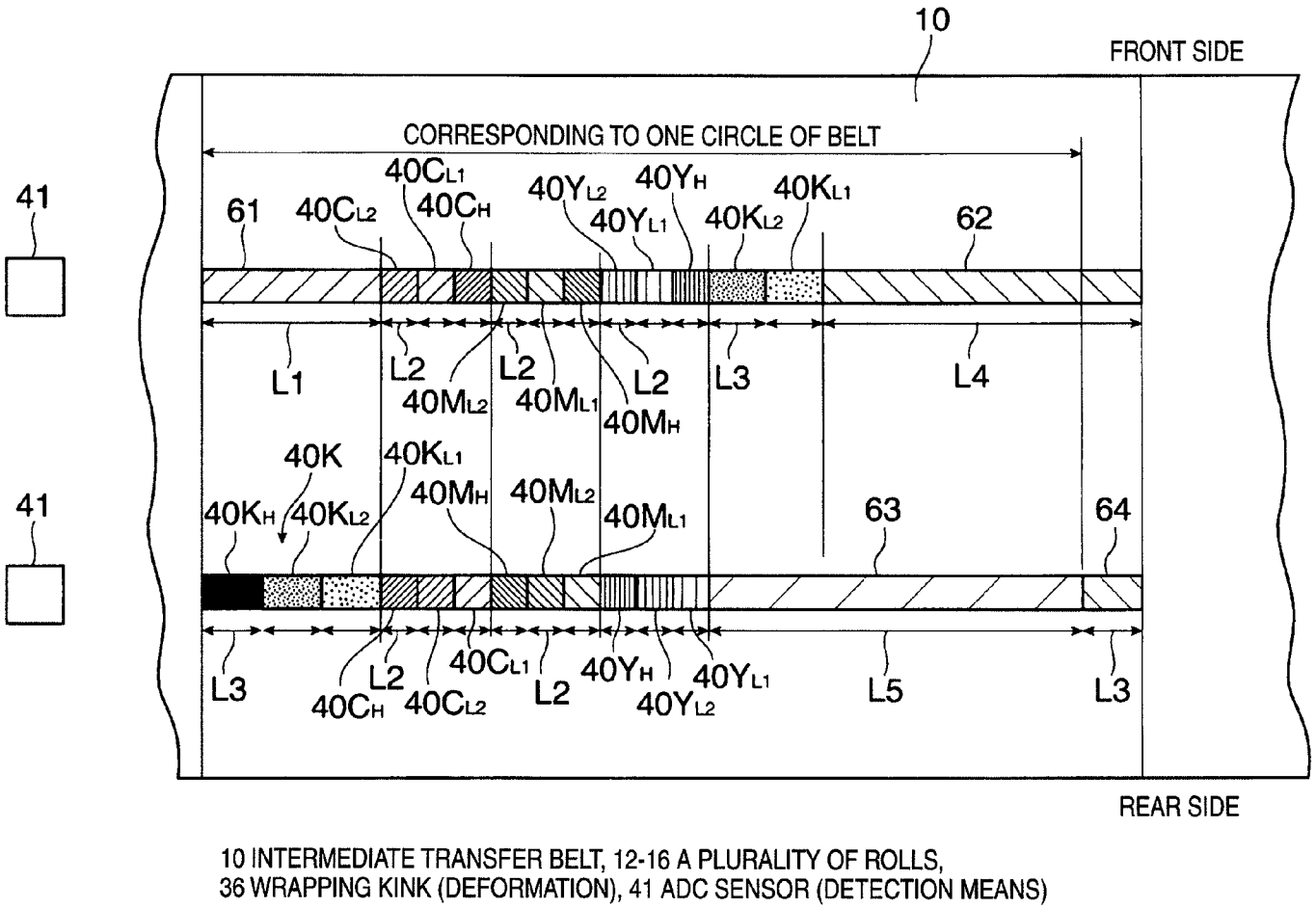
FIG. 1 is a structural view showing toner patches of a color image forming apparatus as an image forming apparatus according to a first embodiment of this invention.
Figure 13:
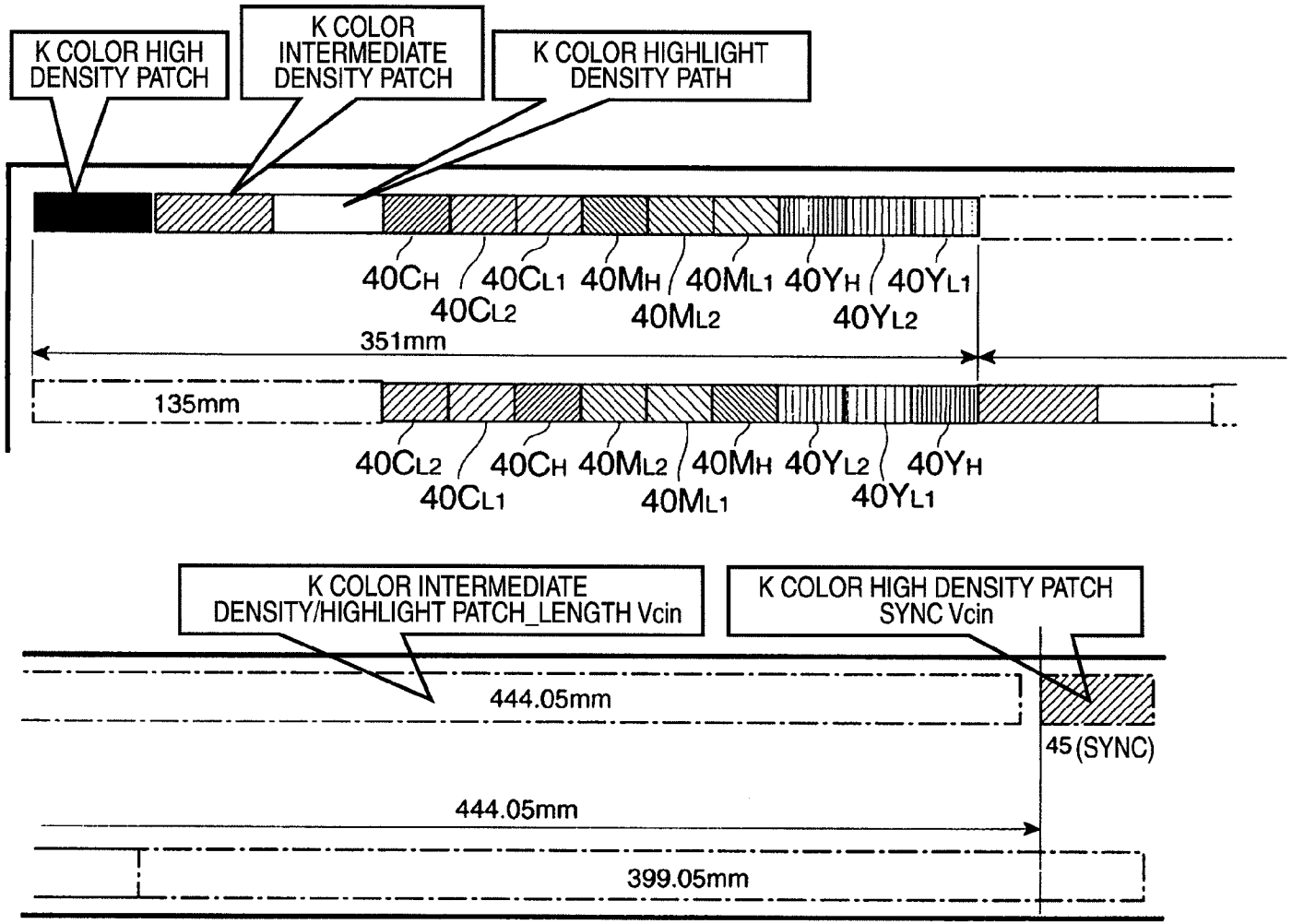
FIG. 13 is a structural view showing the toner patches.

In this embodiment, as shown in FIGS. 1 and 13, considering that the length, in the movement direction of the intermediate transfer belt 10, of the area of the largest wrapping kink 36 caused on the intermediate transfer belt 10 is less than 30 mm in consideration of the diameter of the back supporting roll 13 and the like, the detection area of the toner patch in the movement direction of the intermediate transfer belt 10 is set to approximately 45 mm.

Here, the minimum detection distance A of the detection area of the toner patch in the movement direction of the intermediate transfer belt 10 can be expressed as A>=B+C+D where the diameter of the largest one of the rolls around which the intermediate transfer belt 10 is stretched is B, the length of the area of the wrapping area 36 is C and the length of the ADC sensor 41 in the movement direction of the intermediate transfer belt 10 is D.

Figure 14:
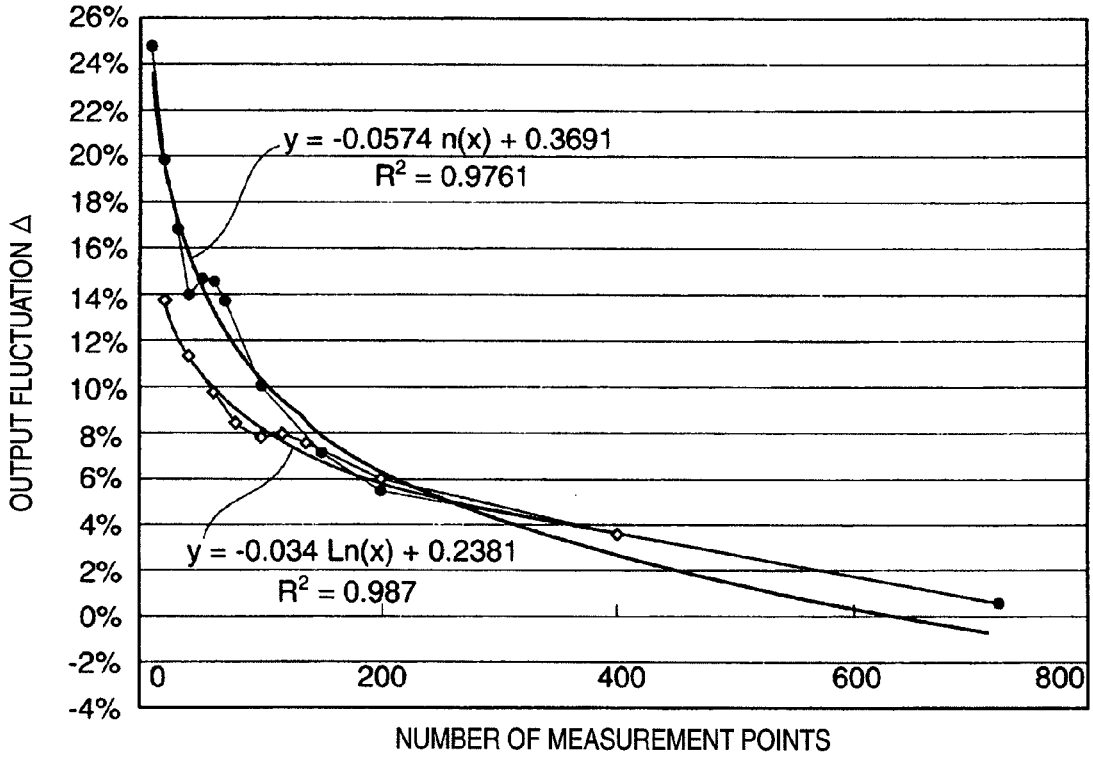
FIG. 14 is a graph showing fluctuations of the output signal of the ADC sensor.

FIG. 14 is a graph of a case where the movement average of the density of the surface of the intermediate transfer belt 10 is obtained while the sampling point is successively shifted in the movement direction of the intermediate transfer belt 10 fluctuating as shown in FIG. 8.

As is apparent from this graph, when the number of measurement points is set to approximately 200, the output fluctuation A of the ADC sensor 41 is approximately not more than 6%, and when the number of measurement points is set to approximately 400, the output fluctuation A of the ADC sensor 41 is approximately not more than 4%.

Therefore, for the density of the no-toner-patch-formed-surface of the intermediate transfer belt 10 where the number of measurement points can be significantly increased, by maximizing the length of the detection area, even if the wrapping kink 36 is caused on the intermediate transfer belt 10, the influence thereof can be substantially ignored.

In the above-described color image forming apparatus, the toner patches 40Y, 40M, 40C and 40K are formed by the image outputter 3 on the surface of the intermediate transfer belt 10 as shown in FIGS. 1 and 13 at a predetermined time such as when the apparatus is turned on, after printing is performed onto a predetermined number of sheets or at the time of return from the sleep mode in a case where printing is not executed for a long period of time, and the density of the surface of the intermediate transfer belt 10 and the densities of the toner patches 40Y, 40M, 40C and 40K formed on the surface of the intermediate transfer belt 10 are detected by the ADC sensors 41.

The detection area of the ADC sensor 41 is set by the control circuit 100 constituted by a CPU or the like as shown in FIG. 2.

In this embodiment, as shown in FIG. 1, on the surface of the intermediate transfer belt 10, the toner patches 40Y, 40M, 40C and 40K are formed in the movement direction of the intermediate transfer belt 10 in two parts on the front side and the rear side. In that case, the toner patches 40Y, 40M, 40C and 40K are formed in such a manner that the same toner patches are formed on the front side and the rear side of the intermediate transfer belt 10 so that their positions in the movement direction of the intermediate transfer belt 10 are different from each other. The densities of the toner patches 40Y, 40M, 40C and 40K are detected by using both of the same toner patches 40Y, 40M, 40C and 40K formed on the front side and the rear side of the intermediate transfer belt 10 so that their positions are different from each other.

Specifically, on the front side of the surface of the intermediate transfer belt 10, as shown in FIGS. 1 and 13, a first mirror finished surface area 61 for detecting the regular reflection density of the surface of the intermediate transfer belt 10 itself where no toner patches are formed is provided over a predetermined length L1.

Moreover, on the front side of the surface of the intermediate transfer belt 10, in succession to the first mirror finished surface area 61, the cyan toner patch 40C is formed in three kinds of densities, a second low density $\mathbf{40}C_{L2}$ (for example, a density of approximately 20 to 60%), a first low density $\mathbf{40}C_{L1}$ (for example, a density of approximately 10 to 30%) and a high density $\mathbf{40}_{H}$ (for example, a density of approximately 60 to 100%) continuously provided each over a predetermined length L2.

Further, on the front side of the surface of the intermediate transfer belt 10, in succession to the cyan toner patch 40C, the magenta and yellow toner patches 40M and 40Y are each formed in three kinds of densities, the second low density (for example, a density of approximately 20 to 60%), the first low density (for example, a density of approximately 10 to 30%) and the high density (for example, a density of approximately 60 to 100%) continuously provided each over the predetermined length L2.

Moreover, on the front side of the surface of the intermediate transfer belt 10, in succession to the yellow toner patch 40Y, the black toner patch 40K is formed in two kinds of densities, the second low density (for example, a density of approximately 20 to 60%) and the first low density (for example, a density of approximately 10 to 30%) continuously provided each over a predetermined length L3.

Further, on the front side of the surface of the intermediate transfer belt 10, in succession to the black toner patch 40K, a second mirror finished surface area 62 for detecting the regular reflection density of the surface of the intermediate transfer belt 10 itself where no toner patches are formed is provided over a predetermined length L4.

The length in the movement direction of the intermediate transfer belt 10 is made different between the black toner patch 40K and the color toner patches 40C, 40M and 40Y as described above for the following reason: In the case of the color toners, since the amount of diffused light which is light, from the light emitting device, diffused by the toners according to the densities thereof is increased, influence of the surface of the intermediate transfer belt 10 is not readily exerted and toner density detection can be performed, whereas in the case of the black toner, since the amount of absorbed light which is light, from the light emitting device, absorbed by the black toner is increased, influence of the reflected light from the surface of the intermediate transfer belt 10 is readily exerted and it is necessary to set a long detection length to thereby reduce the influence of the surface of the intermediate transfer belt 10.

On the other hand, on the rear side of the surface of the intermediate transfer belt 10, as shown in FIG. 1, the black toner patch 40K is formed in three kinds of densities, the high density (for example, a density of approximately 60 to 100%), the second low density (for example, a density of approximately 20 to 60%) and the first low density (for example, a density of approximately 10 to 30%) continuously provided each over the predetermined length L3.

Moreover, on the rear side of the surface of the intermediate transfer belt 10, in succession to the black toner patch 40K, the cyan toner patch 40C is formed, in a different order from the toner patch on the front side, that is, in the order of the high density $\mathbf{40}C_H$ (for example, a density of approximately 60 to 100%), the second low density $\mathbf{40}C_{L2}$ (for example, a density of approximately 20 to 60%) and the first low density $\mathbf{40}C_{L1}$ (for example, a density of approximately 10 to 30%) continuously provided each over the predetermined length L2.

Further, on the rear side of the surface of the intermediate transfer belt 10, in succession to the cyan toner patch 40C, the magenta and yellow toner patches 40M and 40Y are each formed, in a different order from the toner patches on the front side, that is, in the order of the high density (for example, a density of approximately 60 to 100%), the second low density (for example, a density of approximately 20 to 60%) and the first low density (for example, a density of approximately 10 to 30%) continuously provided each over the predetermined length L2.

The reason therefor is as follows: For the cyan, magenta and yellow toner patches 40C, 40M and 40Y, by arranging the toner patches of the same color and the same density in different positions in the circumferential direction of the intermediate transfer belt 10, the wrapping kink caused in the same position in the movement direction of the intermediate transfer belt 10 can be prevented from affecting both the toner patches of the same color and the same density formed in different positions in the axial direction of the rolls around which the intermediate transfer belt 10 is stretched, and as a result, similar effects are obtained as those obtained when the detection length of the toner patches of the same color and the same density is set so as to be elongated in the movement direction of the intermediate transfer belt 10.

Moreover, on the rear side of the surface of the intermediate transfer belt 10, in succession to the yellow toner patch 40Y, a third mirror finished surface area 63 for detecting the regular reflection density of the surface of the intermediate transfer belt 10 itself where no toner patches are formed is provided over a predetermined length L5.

Further, on the rear side of the surface of the intermediate transfer belt 10, in succession to the third mirror finished surface area 63, a fourth mirror finished surface area 64 for detecting the regular reflection density of the surface of the intermediate transfer belt 10 itself where no toner patches are formed is provided over a predetermined length L3. The fourth mirror finished surface area 64 is for detecting the regular reflection density of the surface of the intermediate transfer belt 10 itself where, of the black toner patch 40K formed on the rear side of the surface of the intermediate transfer belt 10, the black toner patch 40K of the high density $\mathbf{40}K_H$ (for example, a density of appropriately 60 to 100%) is formed, and is for accurately detecting the black toner patch 40 of the high density (for example, a density of 60 to 100%) with a small amount of regular reflection as shown in FIG. 8.

Figure 15:
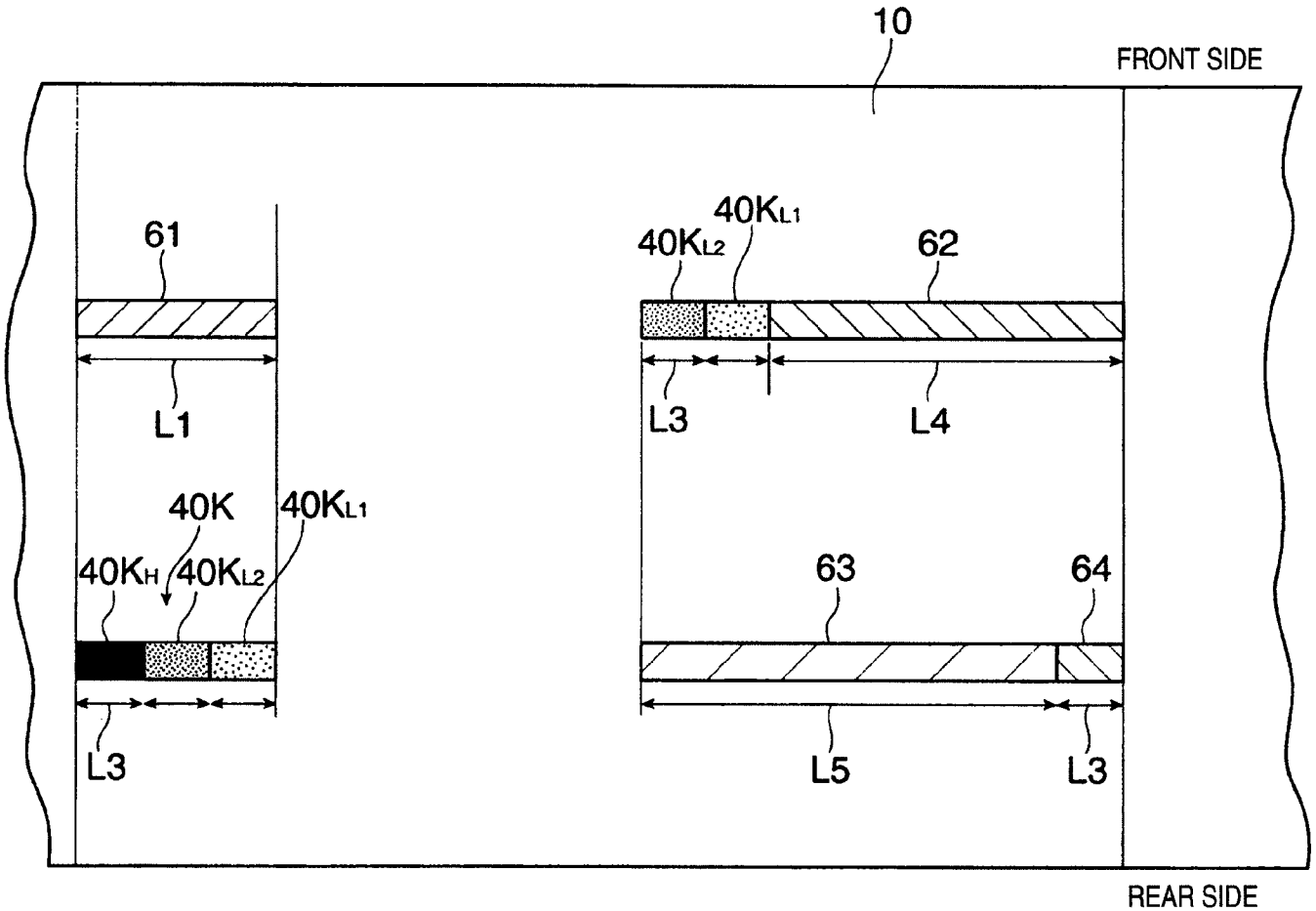
FIG. 15 is a structural view showing the toner patches.

FIG. 15 shows the toner patch formation condition in a case where a monochrome image is formed in the color image forming apparatus. As is apparent from FIG. 15, when a monochrome image is formed, the toner patch formation condition is similar to that shown in FIG. 1 except that the cyan, magenta and yellow toner patches 40C, 40M and 40Y are not formed.

In the above-described structure, in the color image forming apparatus according to this embodiment, even when a wrapping kink is caused on the endless-belt-form image carrier, in the following manner, the density of the toner image formed on the endless-belt-form image carrier can be detected while the influence of the wrapping kink is suppressed:

In the above-described color image forming apparatus, as shown in FIG. 2, in the image forming units 3Y, 3M, 3C and 3K of yellow (Y), magenta (M), cyan (C) and black (K), toner images of yellow (Y), magenta (M), cyan (C) and black (K) are formed, and these toner images are primarily transferred onto the intermediate transfer belt 10 in the primary transfer position so as to be superimposed on one another and then, collectively secondarily transferred from the intermediate transfer belt 10 onto the recording sheet 18 in the secondary transfer position. Then, the recording sheet 18 where the toner images of yellow (Y), magenta (M), cyan (C) and black (K) have been secondarily collectively transferred undergoes fixing by the fixing unit 19, and is then ejected into the output tray 22 by the ejection rolls 21, thereby forming a fullcolor or monochrome image.

In doing this, in the above-described color image forming apparatus, the toner patches 40Y, 40M, 40C and 40K are formed by the image outputter 3 on the surface of the intermediate transfer belt 10 according to the color mode and/or the monochrome mode as shown in FIG. 1 and/or FIG. 15 at a predetermined time such as when the apparatus is turned on, after printing is performed onto a predetermined number of sheets or at the time of return from the sleep mode in a case where printing is not executed for a long period of time, the density of the surface of the intermediate transfer belt 10 and the densities of the toner patches 40Y, 40M, 40C and 40K formed on the surface of the intermediate transfer belt 10 are detected by the ADC sensor 41, and based on the detection signal of the ADC sensor, image density adjustment, toner supply to the secondary transfer roll 17, control of the charging potential of the photoreceptor drum 5 and the like are performed by the control circuit 100.

In the above-described color image forming apparatus, there are cases where in the areas of the intermediate transfer belt 10, made of polyamide-imide, wrapped around or abutting on the driving roll 12, the back supporting roll 13, the tension applying roll 14, the sensor roll 15, the following roll 16 and the primary transfer rolls 11Y, 11M, 11C and 11K as shown in FIG. 3, the wrapping kink 36 plastically deformed along the shapes of the rolls is caused in cases such as when the intermediate transfer belt 10 is left for a long period of time under a high-temperature and high-humidity environment or the like.

As described above, it has been found by researches by the present inventors and others that on the intermediate transfer belt 10, once a wrapping kink is caused, even if image formation is performed thereafter, the wrapping kink 36 is not immediately resolved but the wrapping kink 36 as shown in FIG. 5 remains on the intermediate transfer belt 10 for a while.

If the wrapping kink 36 is caused on the intermediate transfer belt 10, when the densities of the toner patches 40Y, 40M, 40C and 40K formed on the surface of the intermediate transfer belt 10 are detected by the ADC sensor 41, the output of the ADC sensor 41 largely fluctuates as shown in FIG. 8 because of the influence of the wrapping kink 36 of the intermediate transfer belt 10.

Accordingly, in this embodiment, as shown in FIGS. 1 and 15, the length of the detection areas of the toner patches 40Y, 40M, 40C and 40K and the detection area of the surface of the intermediate transfer belt 10 is set to a length that is the sum of the length of the area of the wrapping kink caused on the intermediate transfer belt 10 and a length twice the length of the detection area of the ADC sensor 41.

Therefore, as shown in FIG. 1, for the color toner patches 40Y, 40M, 40C and 40K, the control circuit 100 detects the output of the ADC sensor 41 over the length L1 on each of the front and rear sides of the surface of the intermediate transfer belt 10, thus detecting the output over a long area of a total of L1×2=approximately 48 mm.

For this reason, even if a wrapping kink area of the intermediate transfer belt 10 is included in the detection areas of the toner patches 40Y, 40M, 40C and 40K, the control circuit can determine the wrapping kink area of the intermediate transfer belt 10 by monitoring the output of the ADC sensor 41 as shown in FIG. 8.

Consequently, as shown in FIG. 8, by averaging, of the output of the ADC sensor 41, the output of the area including the wrapping kink area of the intermediate transfer belt 10 or the output of the area other than the wrapping kink area of the intermediate transfer belt 10, even when a wrapping kink is caused on the intermediate transfer belt 10, the control circuit 100 can accurately detect the densities of the toner patches 40Y, 40M, 40C and 40K while the influence of the wrapping kink is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier being stretched around a plurality of rolls, the image carrier having a corrugated area where a portion of the image carrier is plastically deformed; and a detection unit that detects a density of a toner image formed on the image carrier, based on an amount of regularly reflected light from a surface of the image carrier, the detection unit configured to detect light emitted from a toner image within a detection area, wherein a detection length of the detection area in a movement direction of the image carrier is longer than a length, in the movement direction of the image carrier, of a the corrugated area where a deformation of the image carrier is caused, wherein the detection length is a length that is a sum of the length of the corrugated area of the image carrier in the movement direction of the image carrier, and a length which is twice a length of a detection area of the detection unit.

2. The image forming apparatus according to claim 1, the image forming apparatus further comprising:

a deformation determination unit that determines whether a deformation of the image carrier is caused or not is provided, and that determines the presence or absence of generation of the deformation by detecting an output of the detection unit over a length not less than twice a length of a detection area of the detection unit.

3. The image forming apparatus according to claim 2, wherein the detection length is set based on a result of the determination by the deformation determination unit.

4. The image forming apparatus according to claim 1, the image forming apparatus further comprising:

a correction unit that is provided for, when the detection length of the detection unit in the movement direction of the image carrier is set to a length longer than a length of the deformation of the image carrier, averaging the output of the detection unit or performing correction so as to adopt the output of the detection unit other than the output corresponding to the corrugated area.

5. The image forming apparatus according to claim 1, wherein on the image carrier, a plurality of toner images of a plurality of colors of toners arranged in the movement direction of the image carrier are formed in different orders of arrangement of the toners of the plurality of colors so that positions thereof in an axial direction of the rolls around which the image carrier is stretched are different.

6. The image forming apparatus according to claim 1, wherein the detection unit continues the detection over a length longer than the length of the corrugated area.

* * * * *